US006592408B2

(12) United States Patent
Ma et al.

(10) Patent No.: US 6,592,408 B2
(45) Date of Patent: Jul. 15, 2003

(54) SINK-TYPE AUDIO SOCKET CONNECTOR HAVING IMPROVED GROUNDING STRUCTURE

(75) Inventors: Xuedong Ma, Kunsan (CN); GuangXing Shi, Kunsan (CN)

(73) Assignee: Hon Hai Aprecision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/121,073

(22) Filed: Apr. 11, 2002

(65) Prior Publication Data

US 2002/0193006 A1 Dec. 19, 2002

(30) Foreign Application Priority Data

Jun. 13, 2001 (TW) ..... 90209866 U

(51) Int. Cl.[7] ..... H01R 17/18
(52) U.S. Cl. ..... 439/669; 439/607; 439/95
(58) Field of Search ..... 439/669, 607, 439/101, 108, 609, 188, 95, 939

(56) References Cited

U.S. PATENT DOCUMENTS 5,622,523 A * 4/1997 Kan et al. ..... 439/607
5,919,052 A * 7/1999 Ho ..... 439/83
6,050,854 A * 4/2000 Fang et al. ..... 439/607
6,093,058 A * 7/2000 Wu ..... 439/607
6,109,966 A * 8/2000 Chiou ..... 439/607

* cited by examiner

*Primary Examiner*—Hien Vu
(74) *Attorney, Agent, or Firm*—Wei Te Chung

(57) ABSTRACT

An electrical connector (1) comprises an insulating housing (10) defining an insertion hole (122) adapted for insertion of the plug connector. A plurality of terminal receiving slots (170) is defined beside the insertion hole. A plurality of signal terminals (21, 22, 23, 24, 25) is assembled within the terminal receiving slots. Each terminal has a soldering tail (212, 222, 232, 243, 252) located outside the housing. The soldering tails each have a bottom end located between top and bottom walls of the housing and soldered to a printed circuit board (4). Each terminal further comprises a mating portion (213, 223, 233, 243, 253) extending into the insertion hole adapted for contacting with a complementary plug. A shielding (30) is mounted to the housing and having a grounding plate (33) extending downwardly beyond the bottom wall of the housing, adapted for engaging with a conductive grounding device.

5 Claims, 6 Drawing Sheets

SINK-TYPE AUDIO SOCKET CONNECTOR HAVING IMPROVED GROUNDING STRUCTURE

BACKGROUND OF THE INVENTION

1. Field of the Invention

The present invention relates to a socket connector, and particularly to an audio socket connector for mounting to a printed circuit board, in which the connector has a reduced height above the printed circuit board when the connector is mounted thereon.

2. Description of Related Art

Audio socket connectors are broadly applied to radios, records, TVs and other electronic apparatus to transfer audio signals between two audio systems. Recently, the audio socket connectors are more popularly applied in handheld electronic apparatus such as mobile phones, pocket computers and personal digital aids. These socket connectors are mounted on printed circuit boards in the apparatus for contacting with complementary audio plug connectors so that voice information can be transmitted to/from the apparatus.

Referring to FIG. 6, a conventional audio socket connector comprises a rectangular insulating housing 5, a plurality of signal terminals 6 enclosing a front portion 12 of the housing 6. The terminals 6 each comprise a tail 61 protruding beyond a bottom face of the housing 6 for soldering to a printed circuit board (not shown). An insertion hole 51 is defined in the front portion of the housing 5 though which an audio plug can be inserted into the socket connector to electrically connect therebwith. The shielding 7 has a pair of forwardly extending grounding tabs 71 located beside the insertion hole 51 for contacting with an conductive enclosure of an electronic device thereby forming a grounding circuit. However, the size of the grounding plates 71 is limited because it is arranged beside the insertion hole. This results that the reliability of the grounding circuit can not be ensured. In addition, the design that the grounding tabs 71 project in a direction parallel to the force applying direction for insertion/withdrawal of the complementary plug connector into/from the socket connector causes the engagement between the tabs 71 and the enclosure of the electronic device to be unstable. Furthermore, as mentioned, above, such a socket connector is now used in a portable electronic device which has a requirement of trend of minimization; however, for the conventional socket connector, its entire height is almost on the printed circuit board to which the socket connector is mounted. This causes the height of the electronic device not able to be reduced to meet the trend of minimization.

SUMMARY OF THE INVENTION

Accordingly, a first object of the present invention is to provide a sink-type audio socket connector having improved grounding structure.

In order to achieve the object set forth, a socket connector of the present invention is assembled to a printed circuit board and adapted for mating with a complementary plug connector. The socket connector comprises an insulating housing having a mating surface at a front portion thereof, an insertion hole extending through the mating surface adapted for insertion of the plug connector therein, and a plurality of terminal receiving slots defined beside the insertion hole. A plurality of signal terminals is assembled within the terminal receiving slots. Each terminal has a soldering tail located outside the housing. The soldering tails has a bottom end located between top and bottom walls of the housing and soldered to the printed circuit boards. Each terminal further comprises a mating portion extending into the insertion hole adapted for contacting with the complementary plug. A shielding is mounted to the housing and having a grounding plate extending downwardly beyond the bottom wall of the housing, adapted for engaging with a conductive grounding device.

Other objects, advantages and novel features of the invention will become more apparent from the following detailed description of the preferred embodiment when taken in conjunction with the accompanying drawings.

DETAILED DESCRIPTION OF THE INVENTION

Figure 1:
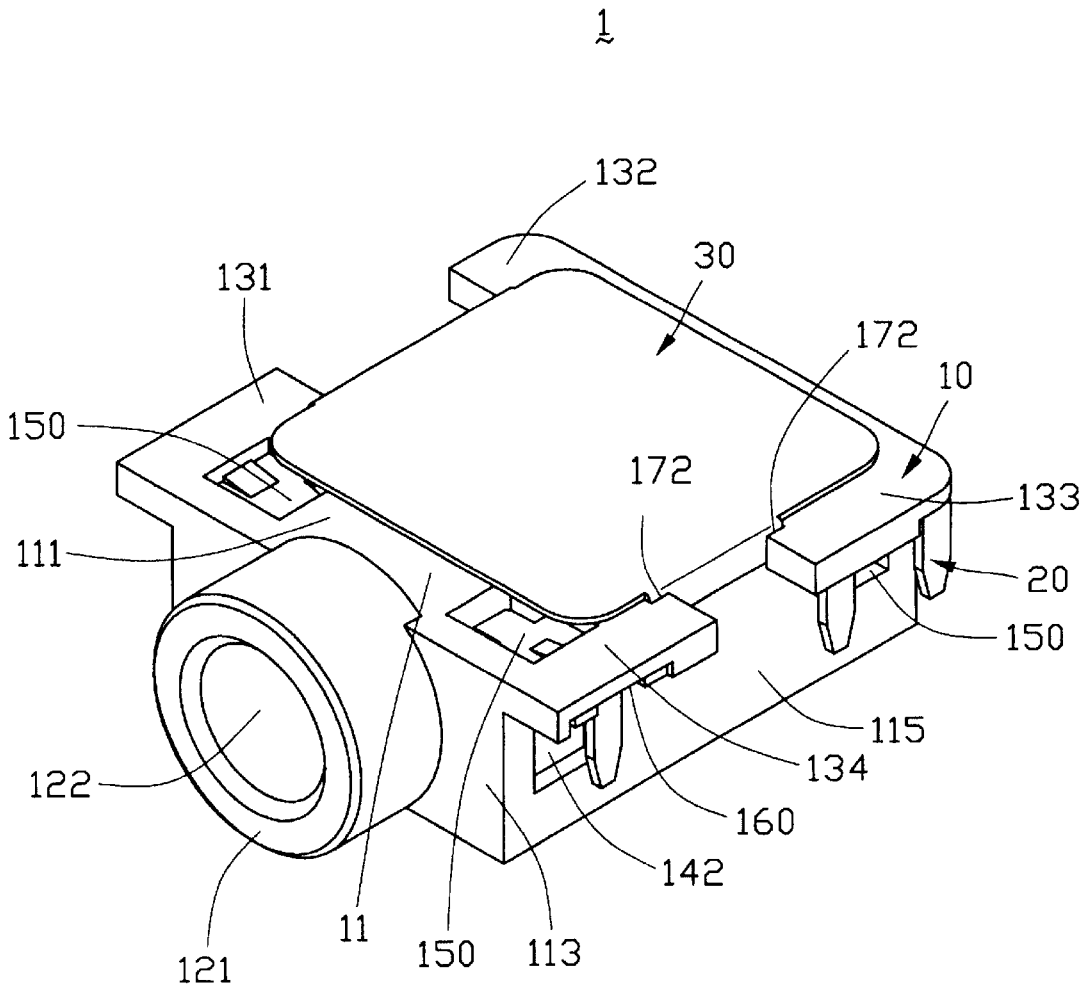
FIG. 1 is a perspective view of a socket connector of the present invention.
Figure 2:
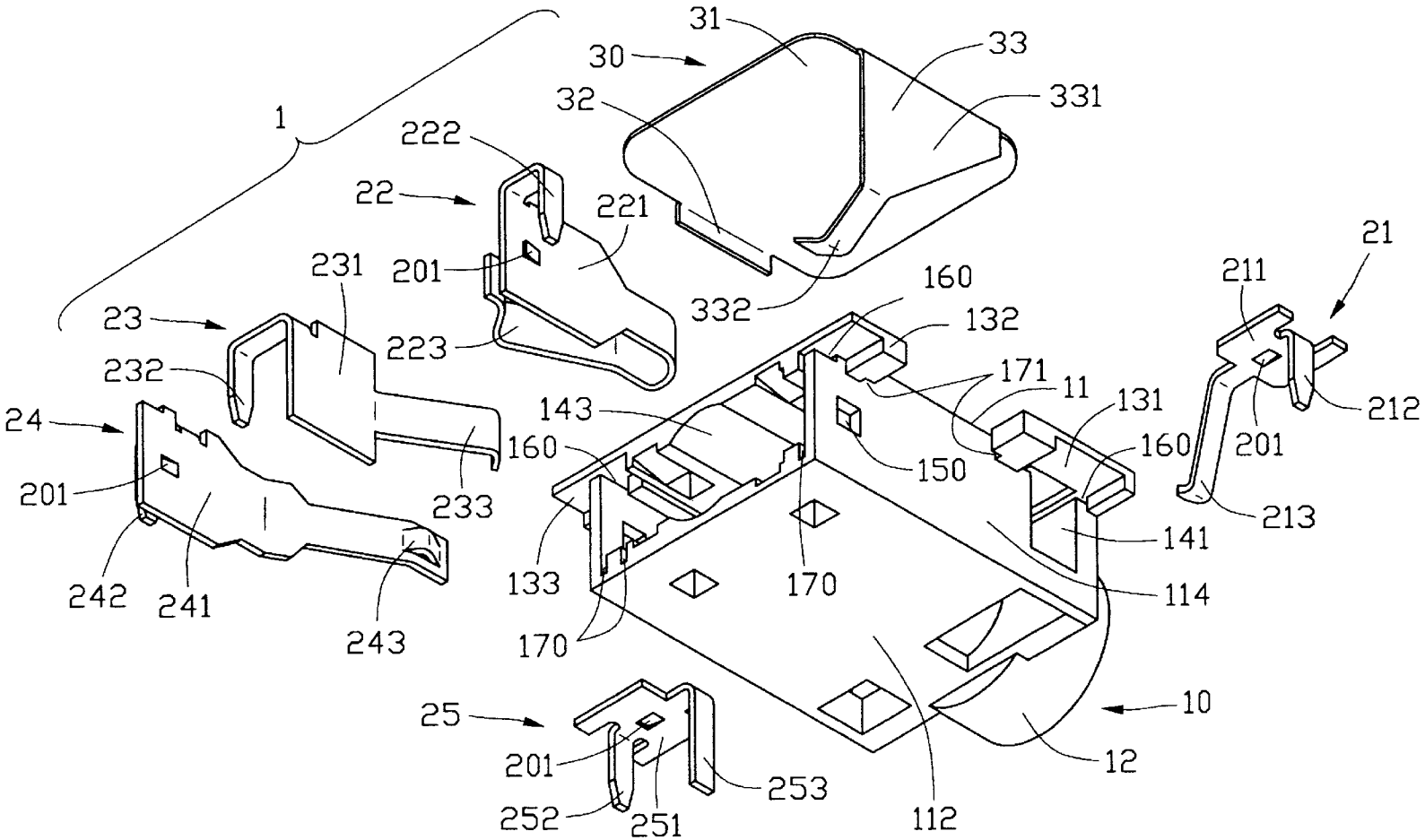
FIG. 2 is an exploded view of the connector of FIG. 1.

Reference will now be made to the drawing figures to describe the present invention in detail.

Referring to FIG. 1, an audio socket connector of the present invention mainly includes an insulating housing 10, a plurality of signal terminals 21, 22, 23, 24, 25 and a shielding 30. The housing 10 includes a rectangular base 11 having a top wall 111, a bottom wall 112, a front wall 113 and two side walls 114, 115. A mating portion 12 is formed at the front wall 113 and has a mating surface 121. An insertion hole 122 is defined in the mating portion 12 through the mating surface 121 into the base 11 for insertion of a complementary plug connector (not shown) into the socket connector 1. The base 11 defines a plurality of terminal receiving slots 170 beside the insertion hole 122 for retaining corresponding terminals therein. A plurality of extending portions 131, 132, 133, 134 horizontally extend outwardly from upper portions of the side walls 114, 115. The extending portions 131, 132, 133, 134 each have a top face coplanar with a top face of the top wall 111. The side walls 114 and 115 of the base 11 of the housing 10 form openings 141, 142, respectively, located near the front wall 113; furthermore, an opening 143 is defined in the base 11 through a rear face (not labeled) of the base 11. These openings, 141, 142, 143 are used for extension of the terminals therethrough to be mounted in the housing 10. The side walls 114 and 115 of the base 11 defines a plurality of securing slots 160 immediately below the extending portions 131, 132, 133, 134. The top wall 111 and the side walls 114 and 115 of the base 11 define a plurality of rectangular holes 150. A pair of narrow slots 171 is defined in the extending portions 131, 132, located immediately outside the side wall 114 and facing each other. A pair of narrow slots 172 is defined in the extending portions 133, 134, located immediately outside the side walls 115 and facing each other. These narrow slots 171 and 172 are used for the securement of shielding 30 to the housing 10.

The terminals comprises first, second, third, forth and fifth terminals 21, 22, 23, 24 and 25. The terminals have securing portions 211, 221, 231, 241 and 251 which are received within the terminal receiving slots 170 and the securing slots 160 of the housing 10, respectively. The terminals further comprise soldering tails 212, 222, 232, 242 and 252 extending from corresponding securing portions 211, 221, 231, 241 and 251, for soldering to a printed circuit board 4 (FIG. 5) by a through-hole manner. The securing portions 221, 231 and 241 are perpendicularly secured within the terminal receiving slots 170. The securing portions 211 and 251 are horizontally secured within the securing slots 160. The soldering tails 222, 232, 242 horizontally extend from upper portions of corresponding securing portions 221, 231, 241 and then extend downwardly. The soldering tails 212 and 252 directly extend perpendicularly and downwardly from side edges of corresponding securing portions 211, 251. The terminals 21, 22, 23, and 24 include mating portions 213, 223, 233 and 243 integrally extending from the securing portions thereof, respectively, for mating with the complementary plug connector when the plug connector is inserted into the socket connector 1. The fifth terminal 25 includes a guiding portion 253 extending downwardly from the securing portion 251, opposite the soldering tail 252. In addition, the securing portions 211, 221, 241 and 251 each form a protrusion 201 thereon for engaging with the base 11 in the rectangular holes 150, to thereby secure the terminals 21, 22, 24, 25 to the housing 10.

The shielding 30 includes a rectangular base plate 31 for covering the top wall 11 I of the base 11 of the housing 10. An elongate, rectangular securing plate 32 depends from a side edge of the base plate 31 and a grounding plate 33 depends from an opposite side edge off the base plate 31. The grounding plate 33 includes a triangular side plate 331 abutting against the side wall 114 of the base 11, wherein front and rear ends of a top of the side plate 331 are engagingly secured within the narrow slots 171, respectively. The grounding plate 33 further has an lower portion configured as an elongate, downwardly-curved flap 332 extending downwardly and laterally inwardly from a bottom end of the triangular side plate 331. The flap 332 is located blow the bottom wall 112 of the base 11 for abutting against a bottom wall 5 (FIG. 5) of a conductive enclosure of an electronic device in which the socket connector 1 is accommodate to thereby form a grounding circuit for the connector 1. A free end of the flap 332 extends toward the bottom wall 112 of the base 11 and spaces therefrom a distance so as to provide the flap 332 with a good resiliency when it abuts against the bottom wall 5 of the enclosure.

Figure 3:
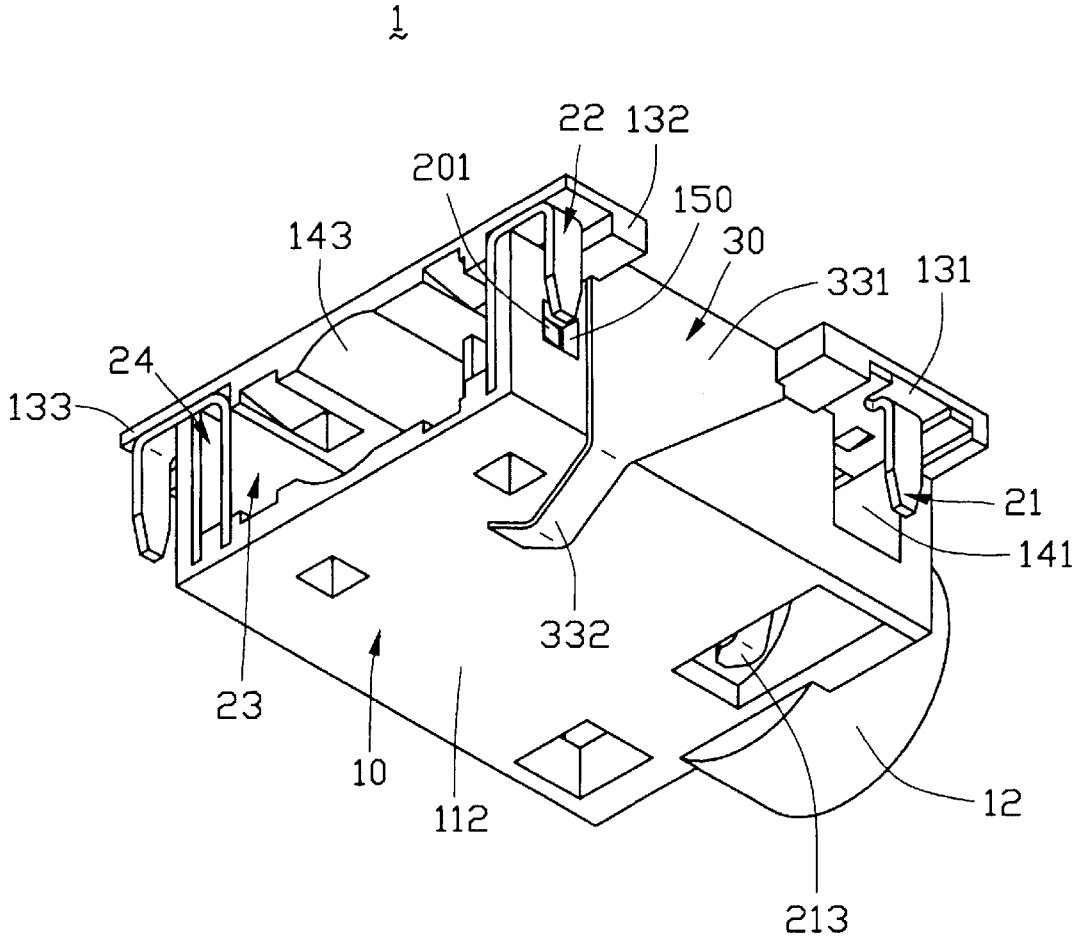
FIG. 3 is a view similar to FIG. 1, from a bottom and rear aspect.
Figure 4:
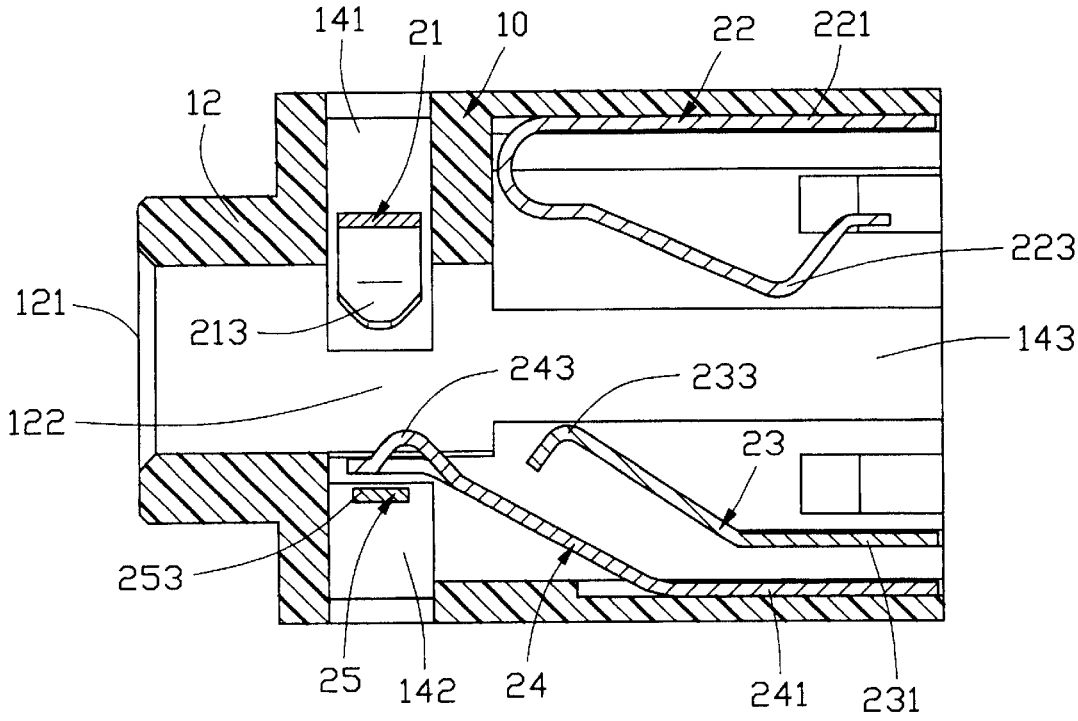
FIG. 4 is a cross-sectional view of the connector of FIG. 1.

Referring to FIGS. 3 and 4, in assembly, the terminals 22, 23 and 24 are secured within the housing 10 from the opening 143. The securing portions 221, 231 and 241 are secured within the terminal receiving slots 170 and the mating portions 223, 233, 243 extend into the insertion hole 122 so as to mate with the complementary plug when the plug is inserted into the insertion hole 122. The soldering tails 222, 232 and 242 are located outside the side walls 114, 115, in which each of the soldering tails 222, 232, 242 has a bottom end located above the bottom wall 112 of the base 11 a distance which is substantially equal to half of a height of the side wall 114 or 115. The securing portions 211, 251 and the horizontal portions of the soldering tails 222, 232, 242 are secured within the securing slots 160 defined under the extending portions 132 and 133. The protrusions 201 of the terminals 22 and 24 engage in the rectangular holes 150 of the side walls 114, 115 to ensure the securement of the terminals 22, 24 to the side walls 114, 115. The terminals 21 and 25 are assembled to the housing 10 by moving the terminals 21, 25 through the openings 141 and 142 of the side walls 114 and 115 of the housing 10. The securing portions 211 and 251 are secured within the securing slots 160 above the openings 141, 142, respectively. The securing portions 211 and 251 also abut against bottom surfaces of the corresponding extending portions 131 and 134 to securely retain the terminals 21, 25 to the housing 10. The mating portion 213 of the first terminal 21 extends into the insertion hole 122 and for engaging with the inserted complementary plug. The guiding portion 253 of the fifth terminal 25 is positioned outside of the mating portion 243 of the forth terminal 24. When the complementary plug is inserted, the mating portion 243 of the forth terminal 24 is outwardly deflected to engage with the guiding portion 253, whereby whether a correct connection between the plug and the socket connector 1 is achieved can be detected by a circuit (not shown) connecting with the terminals 24, 25. The soldering tails 212 and 252 are located outside the side walls 114, 115, respectively. The soldering tails 212, 252, each has a bottom end located at a level the same as that of the other soldering tails 22, 23, 24. The protrusions 201 of the first and fifth terminals 21 and 25 are engaged in the rectangular holes 150 of the top wall 111, respectively, thereby ensuring securement of the terminals 21, 25 to the top wall 111.

Figure 5:
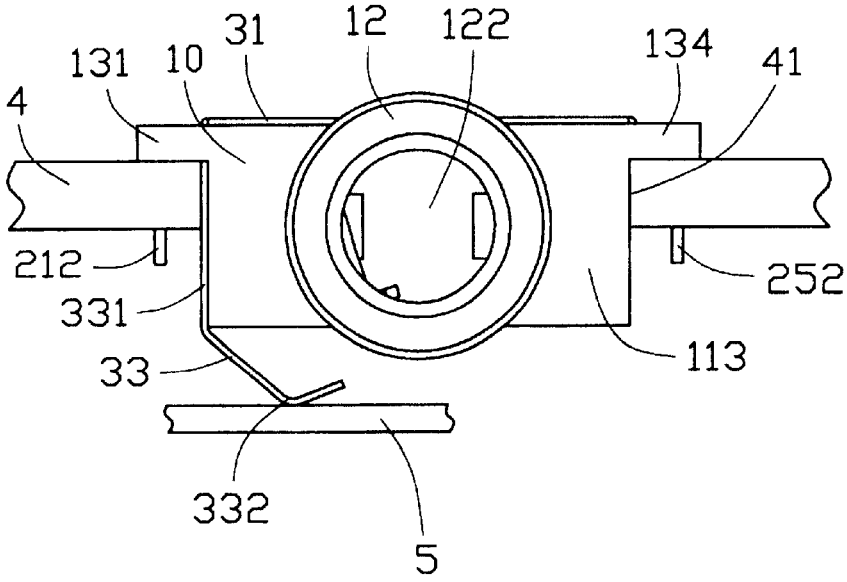
FIG. 5 is a partially front elevational view showing the connector of FIG. 1 mounted to a printed circuit board in a conductive enclosure of an electronic device.
Figure 6:
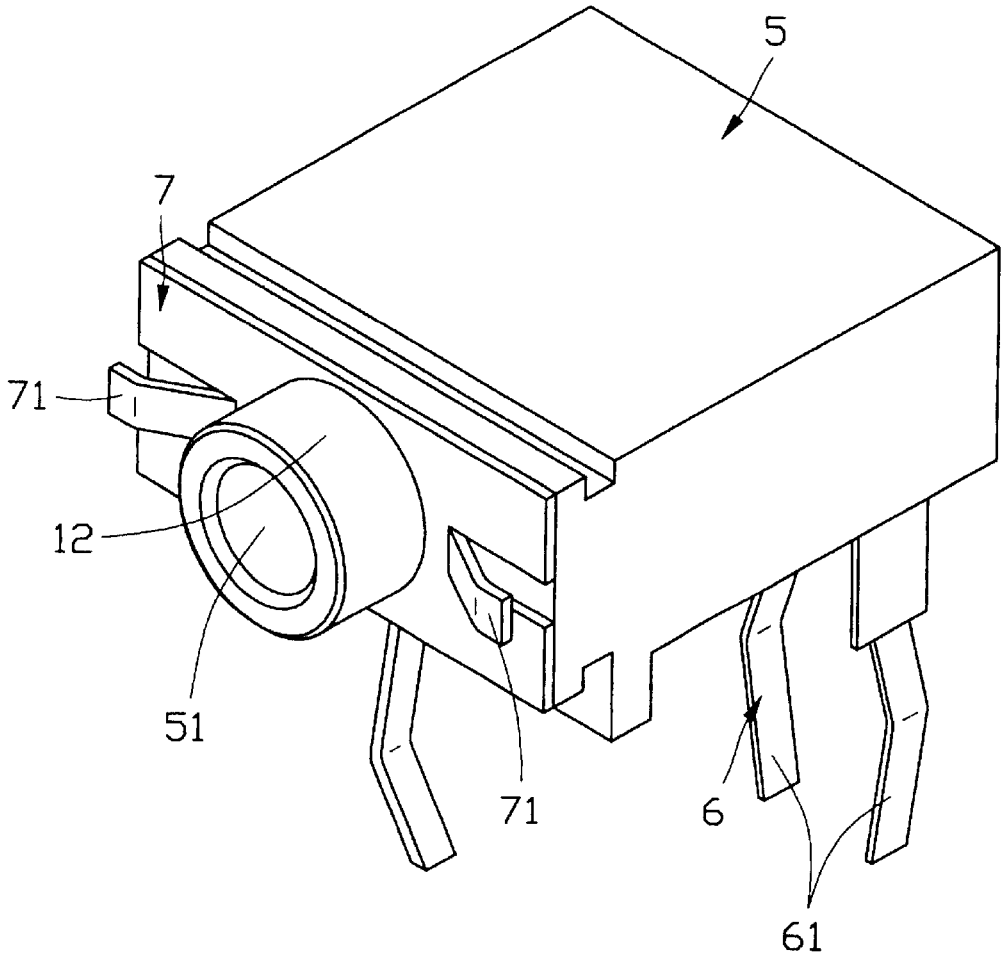
FIG. 6 (PRIOR ART)
FIG. 6 is a perspective view of a prior art audio socket connector.

Referring to FIG. 5, in the present invention, the base 11 of the housing 10 is fitted downwardly through a hole 41 defined in the printed circuit board 4 until the extending portions 131, 132, 133, 134 abut against a top face of the printed circuit board 4, in which the bottom ends of the soldering tails 212, 222, 232, 242, 252 are fined into the plated holes (not shown) of the printed circuit board 4. The bottom ends of the solder tails are then soldered to the plated holes. In the present invention, since a large portion of a profile of the socket connector is positioned under the printed circuit board, the connector 1 has only a small profile above the printed circuit board 4, whereby the electronic apparatus incorporating the socket connector can have a reduced height. Furthermore, since the shielding 30 has a grounding plate 33 with a flap 332 laterally and downwardly extending to engage with the bottom plate 5 of the conductive enclosure of the electronic apparatus, the engagement between the shielding 30 and the enclosure is not susceptible to the force for inserting/withdrawing the plug connector into/from the socket connector 1. Accordingly, the shielding/grounding effectiveness of the connector 1 can be improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket connector, assembled to a printed circuit board and adapted for mating with a complementary plug connector, the socket connector comprising:

an insulating housing having a cylindrical mating portion with a mating surface at a front portion thereof, an insertion hole extending through the mating surface adapted for insertion of the plug connector therein, and a plurality of terminal receiving slots defined beside the insertion hole;

a plurality of signal terminals assembled within the terminal receiving slots, each of the terminals having a soldering tail located outside the housing, the soldering tail having a bottom end located between top and bottom walls of the housing and soldered to the printed circuit boards, and a mating portion extending into the insertion hole adapted for contacting with the complementary plug; and a metal shielding mounted to the housing, the shielding having a grounding plate extending downwardly beyond the bottom wall of the housing, adapted for engaging with a conductive grounding device; wherein the housing further includes a pair of side walls integrally connecting with the top and bottom walls, said walls defining a rectangular base; wherein an extending portion is farmed at an upper portion of each of two side walls of the housing, the extending portions abutting against a top face of the printed circuit board; wherein the shielding has a rectangular base plate covering the top face of the top wall, the grounding plate extending downwardly from a side edge of the base and a rectangular securing plate extending from an opposite side edge of the base plate; wherein the grounding plate includes a triangular side plate connecting with the base plate, and a flap laterally and downwardly extending from a bottom end of the side plate, the flap being adapted for engaging with the conductive enclosure, a free end of the flap being oriented toward the bottom wall of the housing and spaced therefrom; wherein a narrow slot is defined in each of the extending portions, and the shielding fitting in the narrow slots; wherein an upper portion of the side plate of the grounding plate and the securing plate are secured within the narrow slots of the extending portions.

2. The socket connector as claimed in claim 1, wherein the extending portions are horizontally formed at a top of the side walls of the housing, the extending portions each having a top face coplanar with a top face of the top wall of the housing.

3. The socket connector as claimed in claim 1, wherein each terminal has a securing portion received within a corresponding terminal receiving slot of the housing, said soldering tails connecting with the securing portions, respectively.

4. The socket connector as claimed in claim 3, wherein the soldering tails of the terminals are located beside the side walls and under the extending portions of the housing, respectively.

5. The socket connector as claimed in claim 4, wherein a profile of the housing has a large portion being located below the printed circuit board.

* * * * *